US008134543B1

(12) United States Patent
Han

(10) Patent No.: US 8,134,543 B1
(45) Date of Patent: Mar. 13, 2012

(54) SYSTEM, METHOD, AND COMPUTER PROGRAM PRODUCT FOR DRIVING A DISPLAY UTILIZING A COMPENSATED REFRESH RATE

(75) Inventor: Gang Han, San Jose, CA (US)

(73) Assignee: NVIDIA Corporation, Santa Clara, CA (US)

( * ) Notice: Subject to any disclaimer, the term of this patent is extended or adjusted under 35 U.S.C. 154(b) by 823 days.

(21) Appl. No.: 11/681,093

(22) Filed: Mar. 1, 2007

(51) Int. Cl.
*G09G 5/00* (2006.01)

(52) U.S. Cl. ..... 345/204

(58) Field of Classification Search ..... 345/111, 345/213, 661, 204
See application file for complete search history.

(56) References Cited

U.S. PATENT DOCUMENTS

| | | | | |
|---|---|---|---|---|
| 6,232,952 | B1 * | 5/2001 | Eglit | 345/661 |
| 6,441,812 | B1 * | 8/2002 | Voltz | 345/213 |
| 7,154,495 | B1 * | 12/2006 | Bucklen | 345/213 |
| 2006/0256102 | A1 * | 11/2006 | Swan | 345/213 |
| 2009/0091473 | A1 * | 4/2009 | Lyle et al. | 340/905 |

* cited by examiner

*Primary Examiner* — Quan-Zhen Wang
*Assistant Examiner* — Tony Davis
(74) *Attorney, Agent, or Firm* — Zilka-Kotab, PC

(57) ABSTRACT

A system, method, and computer program product are provided for driving a display utilizing a compensated refresh rate. In use, a pixel clock is received. The present technique compensates for an error associated with the pixel clock. Further, a refresh rate is calculated based on such compensation. To this end, a display may be driven utilizing the refresh rate.

24 Claims, 5 Drawing Sheets

SYSTEM, METHOD, AND COMPUTER PROGRAM PRODUCT FOR DRIVING A DISPLAY UTILIZING A COMPENSATED REFRESH RATE

FIELD OF THE INVENTION

The present invention relates to display systems, and more particularly to driving displays.

BACKGROUND

Conventional display devices (e.g. computer monitors, etc.) are equipped to receive visual data (e.g. images, video, etc.) from host devices for displaying the same images or video. One example of such a host device includes a digital versatile disc (DVD) player which facilitates DVD playback on the display device. Oftentimes, refresh rates associated with display devices are slightly different from operational rates supported by the abovementioned host devices. For example, a display device may be driven with a refresh rate of 60 Hertz, while a DVD player may operate at a rate of 59.94 Hertz. This, in turn, results in periodic frame drops (e.g. every 5 seconds, etc.) and unwanted jitter, etc.

Further, hardware (e.g. graphics processors, etc.) has traditionally been unable to reconcile such rate differences, in particular, such hardware is typically limited in its ability to make adjustments to a pixel clock used to drive a display device. Specifically, pixel clocks of such hardware customarily exhibit error ranges (e.g. +/−0.5%, etc.) which are larger than the difference in operational rates of the abovementioned display devices and host devices. To this end, such hardware has been unable to adequately accommodate the foregoing rate differences.

There is thus a need for addressing these and/or other issues associated with the prior art.

SUMMARY

A system, method, and computer program product are provided for driving a display utilizing a compensated refresh rate. In use, a pixel clock is received. The present technique compensates for an error associated with the pixel clock. Further, a refresh rate is calculated based on such compensation. To this end, a display may be driven utilizing the refresh rate.

DETAILED DESCRIPTION

Figure 1:
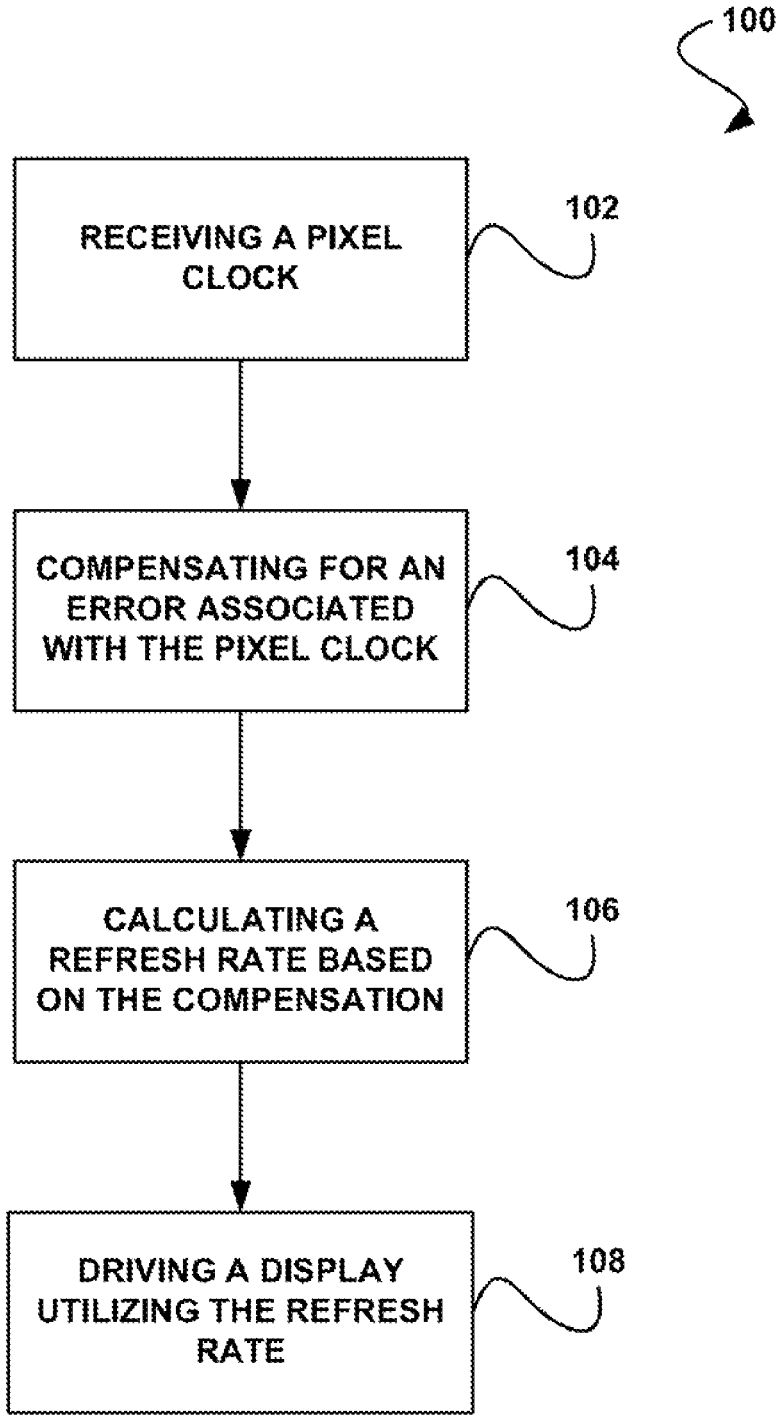
FIG. 1 shows a method for driving a display utilizing a compensated refresh rate, in accordance with one embodiment.

FIG. 1 shows a method 100 for driving a display utilizing, a compensated refresh rate, in accordance with one embodiment. As shown in operation 102, a pixel clock is received, in the context of the present description, the pixel clock may refer to any clock that is capable of being used in calculating a refresh rate of a display. In one embodiment, for example, the pixel clock is the frequency which dictates a rate in which visual data (e.g. images, video, etc.) is sampled for output purposes.

In another embodiment, the pixel clock may be generated utilizing a phase locked loop (PLL). Such PLL may optionally be associated with a graphics processor [e.g. graphics processing unit (GPU), etc.]. As another option, the PLL, and thus the pixel clock, is associated with a certain error range (e.g. 0.5%, etc.). Of course, any error associated with the pixel clock is contemplated, which may or may not be attributed to this and/or other system components.

Additionally, compensation is provided for the error associated with the pixel clock. See operation 104. In the context of the present description, such compensation refers to anything capable of having a ramification on a resultant refresh rate, in the manner that will be set forth in operation 106.

In one embodiment, the compensation may include modifying a horizontal timing value and/or vertical timing value. In the context of the present description, such horizontal and vertical timing values contribute to a time it takes for an image to be displayed on a display device. In one embodiment, the horizontal and vertical timing values may correspond to a timing associated with the output of an image by a graphics processor to the display.

In one embodiment, the horizontal timing value may include a sum of a horizontal visible time (e.g. $H_{VISIBLE}$), a horizontal blanking time (e.g. $H_{BLANK}$) which includes a horizontal sync time (e.g. $H_{SYNC}$). The horizontal visible time may include a time period utilized for displaying a plurality of scan lines (e.g. horizontal lines) on a display. In addition, the horizontal blanking time may include a time period utilized for returning from the end of each scan line to a beginning of a next scan line. Further, the horizontal sync time may include a time period utilized for instructing the return from the end of each scan line, to the beginning of the next scan line. Thus, as an option, $H_T=H_{VISIBLE}+H_{BLANK}$. Accordingly, the horizontal timing value may be modified by modifying any and/or all of the horizontal visible time, the horizontal blanking time, and/or the horizontal sync time.

In another embodiment, the vertical timing value may include a sum of a vertical visible time (e.g. $V_{VISIBLE}$), a vertical blanking time (e.g. $V_{BLANK}$) which includes a vertical sync time (e.g. $V_{SYNC}$). The vertical visible time may include a time period utilized for displaying the entire horizontal scan lines described above. Additionally, the vertical blanking time may include a time period utilized in returning from the end of a last scan line of a display to the beginning of a first scan line of the display (e.g. from the bottom of the display to the top of the display, etc.). Still yet, the vertical sync time may include a time period utilized for instructing the return from the end of the last scan line of the display, to the beginning of the first scan line of the display. To this end, $V_T=V_{VISIBLE}+V_{BLANK}$. Therefore, the vertical timing value may be modified by modifying any and/or all of the vertical visible time, the vertical blanking time, and/or the vertical sync time.

In a further embodiment, the compensation may optionally be based on a layout of visual data to be displayed. For example, if the layout includes a portrait layout (as determined from the visual data itself and/or a current mode of the display), the vertical timing value may be adjusted prior to the horizontal timing value. In a similar manner, if the layout includes a landscape layout, the horizontal timing value may be adjusted prior to the vertical timing value.

Of course it should be noted that, while the compensation is described above with respect to a horizontal timing value and/or a vertical timing value, the compensation may be determined in any desired manner. In yet another embodiment, the compensation may utilize a feedback loop. Just by way of example, the compensation may be based on an actual pixel clock value of an associated graphics processor PLL. Further, the compensation may be based on a difference between a requested pixel clock value and the actual pixel clock value. In this way, the compensation may optionally be utilized to conform the actual pixel clock value, to the extent possible, with the requested pixel clock value.

In still yet another embodiment, the compensation may be limited based on a predefined threshold. Optionally, such threshold may include a percentage change threshold (e.g. 0.01%, 0.001% etc.). Such threshold may optionally be based on the particular graphics processor for which the error is being compensated. For example, the threshold may be based on a maximum compensation capable of being utilized while preventing a divergent result.

Moreover, a refresh rate is calculated based on the compensation, as shown in operation 106, in the present description, the refresh rate includes a rate in which visual data is displayed on a display. In the context of the compensation described above, the refresh rate may include the pixel clock divided by a product of the horizontal timing value and the vertical timing value. Of course, however, the refresh rate may be calculated in any desired manner.

In addition, as shown in operation 108, a display is driven utilizing the compensated refresh rate. In one embodiment, the compensated refresh rate may be implied by the timing (e.g. a modified $H_{BLANK}$ or $V_{BLANK}$). In the context of the present embodiment, the display may include any device capable of displaying visual data. Such visual data may include images, video, text, etc. To this end, in various embodiments, the display may include a computer monitor, a television, a mobile display or screen, and/or any other display, for that matter.

In one example of use, the display may be driven for displaying such visual data at the calculated refresh rate. In this way, the display may depict the visual data utilizing a refresh rate calculated based on the compensation provided with respect to the error of the pixel clock. Accordingly, in different embodiments, one or more refresh rates may be automatically provided based such calculation. Furthermore, refresh rates may be calculated based on any received pixel clock, thus allowing for the provision of refresh rates to a plurality of different types of devices, etc.

More illustrative information will now be set forth regarding various optional architectures and features with which the foregoing framework may or may not be implemented, per the desires of the user. It should be strongly noted that the following information is set forth for illustrative purposes and should not be construed as limiting in any manner. Any of the following features may be optionally incorporated with or without the exclusion of other features described.

Figure 2:
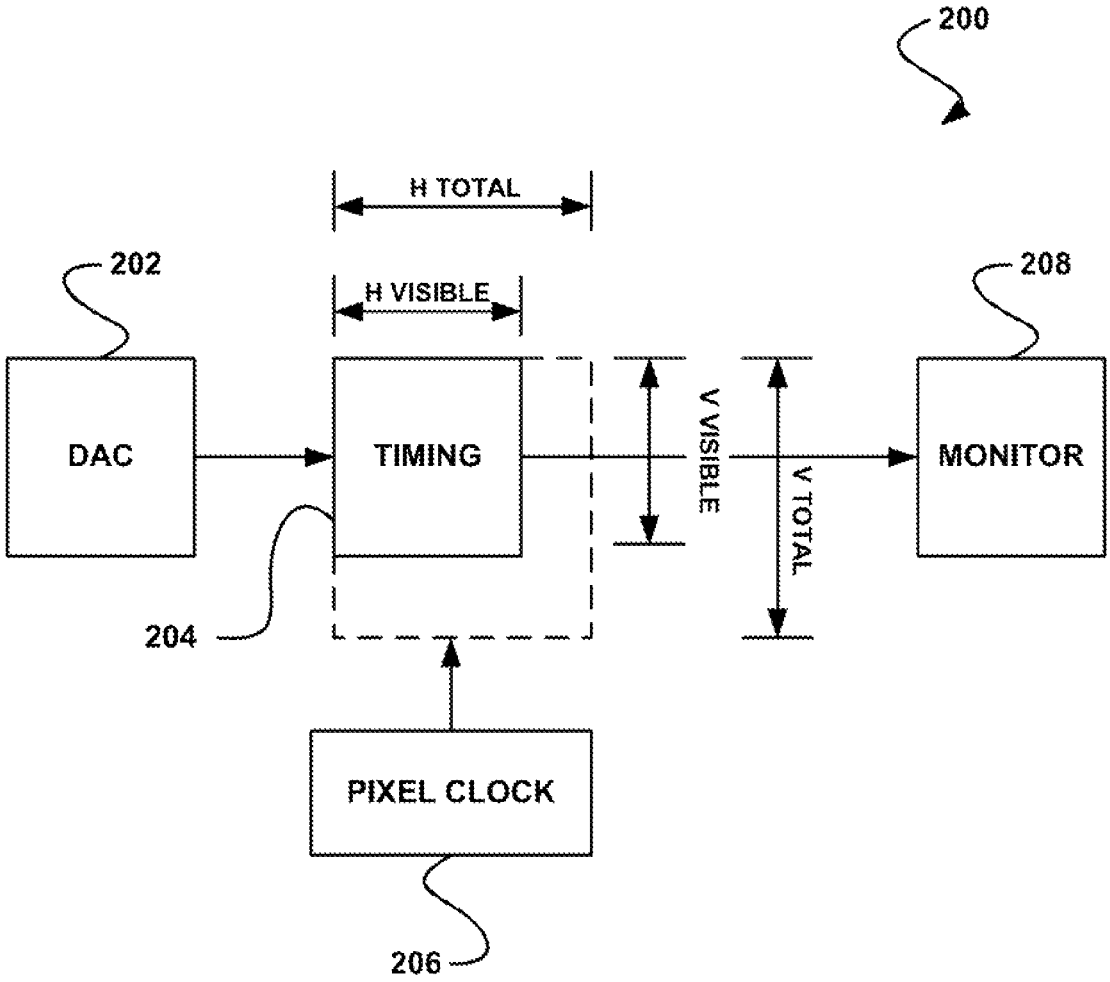
FIG. 2 shows a system for driving a display without utilizing a compensated refresh rate, in accordance with another embodiment.

FIG. 2 shows a system 200 for driving a display utilizing a calculated refresh rate, in accordance with another embodiment. As an option, the present system 200 may be implemented to carry out the method 100 of FIG. 1. Of course, however, the system 200 may be implemented in any desired environment it should also be noted that the aforementioned definitions may apply during the present description.

As shown, a digital-to-analog converter (DAC) 202 transmits a signal with an associated timing 204. The timing 204 may be controlled by any module capable of calculating a refresh rate utilized by a monitor 208. As shown, the timing 204 includes horizontal and vertical timing values (i.e. H total and V total). The horizontal and vertical timing values may include actual timing values associated with a graphics processor. Additionally, in the context of the present description, the horizontal and vertical timing values are larger than the horizontal and vertical visible values. For example, the horizontal and vertical timing values may include the horizontal and vertical visible values, along with horizontal and vertical blanking values, and/or horizontal and vertical sync values, respectively.

In addition, the timing 204 is operated at a certain pixel clock 206. In one embodiment, the pixel clock 206 may include an actual pixel clock associated with (e.g. utilized by, etc.) a graphics processor. A refresh rate of the monitor 208 may thus be calculated based on the horizontal and vertical timing values, and the pixel clock 206.

Table 1 illustrates an exemplary equation utilized for calculating the refresh rate. It should be noted that the equation shown in Table 1 is set forth for illustrative purposes only, and should not be construed as limiting in any manner.

TABLE 1

| |
|---|
| refresh rate = pixel clock/($H_T$ * $V_T$) |

Further, the refresh rate is utilized to drive the monitor 208. In one embodiment, the refresh rate may be utilized by a graphics processor to drive the monitor 208.

Figure 3:
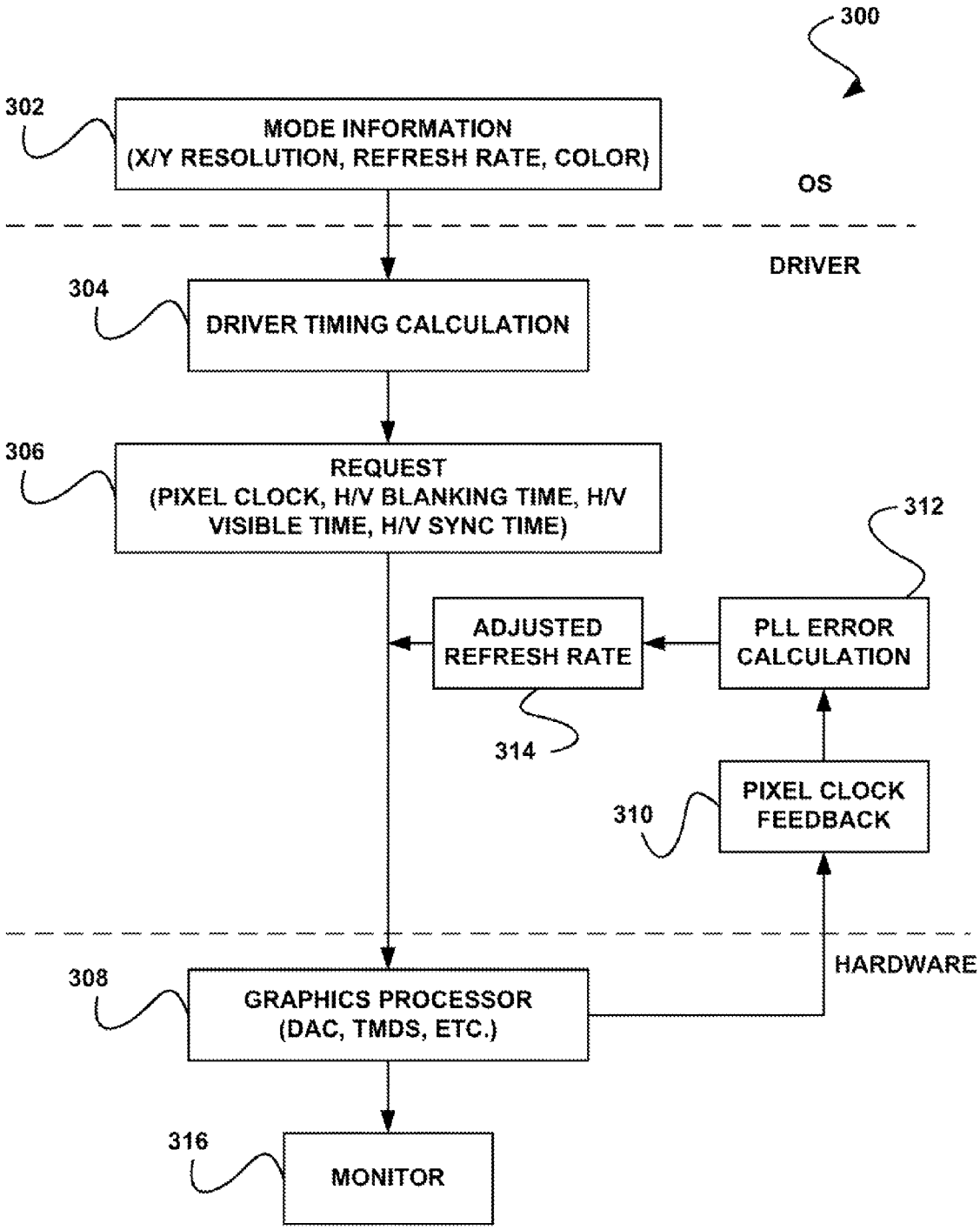
FIG. 3 shows a system for calculating a compensated refresh rate utilized in driving a display, in accordance with yet another embodiment.

FIG. 3 shows a system 300 for calculating a compensated refresh rate utilized in driving a display, in accordance with yet another embodiment. As an option, the present system 300 may be implemented in the context of the functionality and architecture of FIGS. 1-2. Of course, however, the system 300 may be carried out in any desired environment. It should also be noted that the aforementioned definitions may apply during the present description.

As shown, mode information 302 is received from an operating system. While an operating system is shown in the context of the present embodiment, it should be noted that the mode information may also be received from any other source (e.g. application, user, etc.). In one embodiment, the mode information may be associated with a host device.

For example, such host device may include a DVD player and/or any other device capable of providing visual data as input to a monitor 316, such that the monitor 316 is capable of outputting such visual data. To this end, the mode information 302 may optionally include information associated with visual data to be output via the monitor 316. In various embodiments, the mode information 302 may include a resolution (e.g. X/Y resolution), a refresh rate, color, etc.

The mode information 302 is transmitted to a driver timing calculation module 304. As shown, the driver timing calculation module 304 is included within a driver. Such driver may include computer code and/or hardware logic. Further, the driver may be utilized for driving hardware (e.g. graphics processor 308, etc.), for example.

The driver timing calculation module 304 utilizes the mode information 302 to calculate a request 306. As shown, the request 306 includes a plurality of parameters, such as a pixel clock, a horizontal and vertical blanking time, a horizontal and vertical visible time, and a horizontal and vertical sync time. Of course, however, the request 306 may also include any other desired parameters capable of being associated with the mode information 302. In this way, the parameters within the request 306 may be calculated utilizing the mode information 302.

Further, the request 306 is transmitted to the graphics processor 308. As shown, the graphics processor 308 may include various components, such as a digital-to-analog converter (DAC), transition minimized differential signaling (TMDS), etc. It should be noted that, while a graphics processor 308 is described in the present embodiment, any desired hardware capable of processing visual data may be utilized.

To this end, the graphics processor 308 may include any graphics processor capable of processing the request 306. For example, the graphics processor 306 may implement the parameters within the request 306 when processing visual data. Optionally, the graphics processor 308 may implement the parameters in order to attempt to deliver the refresh rate associated with the mode information 302.

As further shown, the graphics processor 308 transmits pixel clock feedback to a pixel clock feedback module 310 of the driver. In one embodiment, the pixel clock feedback may include an actual pixel clock associated with an output of the graphics processor 308. For example, the actual pixel clock may include an actual pixel clock utilized by the graphics processor 308 when processing visual data.

Due to a possible lack of precision associated with a pixel clock of the graphics processor 308, the actual pixel clock may be different than the pixel clock included in the request 306. For example, the actual pixel clock may vary from the requested pixel clock because of an error range associated with the pixel clock of the graphics processor 308. For example, the pixel clock of the graphics processor 308 may include an error range of +/−0.5%, such that the actual pixel clock may vary from the requested pixel clock by up to 0.5%.

As also shown, the pixel clock feedback is transmitted to a PLL error compensation module 312 of the driver. In one embodiment, the PLL error compensation module 312 is capable of compensating for the difference between the requested pixel clock included in the request 306 and the actual pixel clock resulting from the graphics processor 308. Accordingly, the PLL error compensation module 312 may allow the graphics processor 308 to support an adjusted refresh rate 314 that better corresponds with the refresh rate included in the mode information 302.

Still yet, such compensation provided by the PLL error compensation module 312 may be accomplished by modifying a horizontal timing value and/or a vertical timing value. In one embodiment, the horizontal and vertical timing values may be associated with the request 306. In use, the horizontal and/or vertical timing values may be modified, because the pixel clock is incapable of being modified.

In one embodiment, the horizontal and/or vertical timing values may be modified by modifying a component thereof. For example, the horizontal and vertical timing values may each include a sum of a horizontal/vertical visible value, a horizontal/vertical blanking value, and/or a horizontal/vertical sync value. Thus, in one optional embodiment, the horizontal and/or vertical timing values may be modified by modifying the horizontal/vertical visible value, the horizontal/vertical blanking value, and/or the horizontal/vertical sync value.

Optionally, the horizontal and/or vertical timing values may be modified had on a layout (e.g. portrait or landscape, etc.) of visual data to be processed by the graphics processor 308. For example, with respect to a landscape layout, the horizontal timing value may be modified prior to the vertical timing value. As another example, with respect to a portrait layout, the vertical timing value may be modified prior to the horizontal timing value. One example of modifying the horizontal and vertical timing values based on a portrait layout will be described in more detail below with respect to FIG. 4.

As another option, the horizontal and/or vertical timing values may be modified based on a threshold. For example, the horizontal and/or vertical timing values may only be modified such that the resultant refresh rate is maintained within the threshold (e.g. 0.01%, 0.001%, etc.). Such threshold may indicate a maximum modification capable of being made to the actual refresh rate, while still ensuring the prevention of a divergent result. Further, the threshold may optionally be based on details of the graphics processor 308 (e.g. type of graphics processor, etc.).

The compensation may then be utilized to calculate the adjusted refresh rate 314. For example, the refresh rate may be calculated utilizing the equation described above with respect to Table 1. Still yet, the adjusted refresh rate is fed back to the graphics processor 308. Thus, the graphics processor 308 may utilize the adjusted refresh rate, such that frame dropping of visual data displayed by the monitor 316 is reduced to the extent possible.

Figure 4:
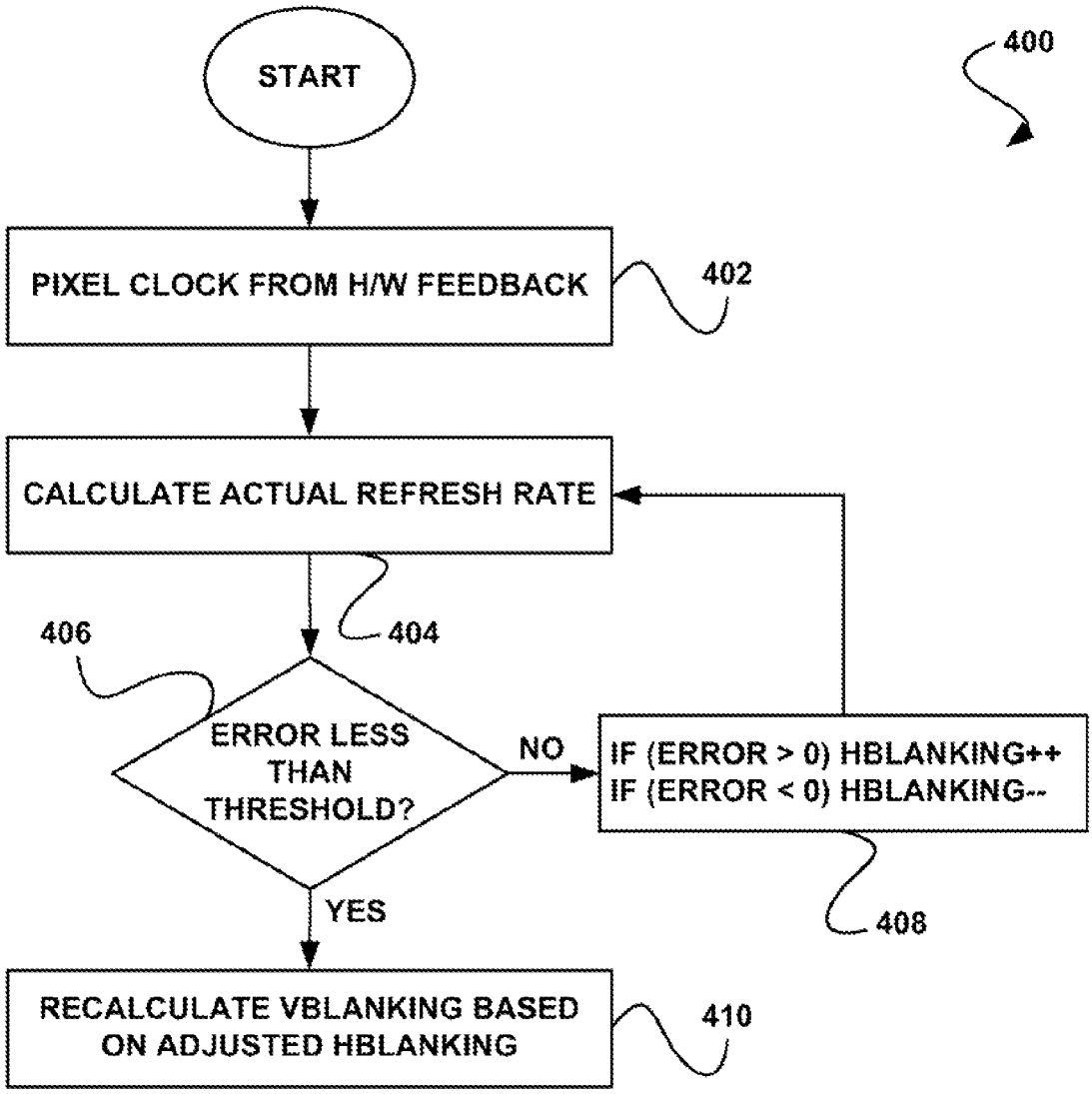
FIG. 4 shows a method for adjusting a refresh rate based on an actual pixel clock utilized in portrait mode, in accordance with still yet another embodiment.

FIG. 4 shows a method 400 for adjusting a refresh rate based on an actual refresh rate utilized in portrait mode, in accordance with still yet another embodiment. As an option, the present method 400 may be implemented in the context of the functionality and architecture of FIGS. 1-3. Of course, however, the method 400 may be carried out in any desired environment. It should also be noted that the aforementioned definitions may apply during the present description.

As shown in operation 402, a pixel clock is received from hardware (e.g. graphics processor) feedback. In addition, an actual refresh rate is calculated (operation 404). For example, the actual refresh rate associated with the hardware may be calculated based on an actual pixel clock associated therewith.

As further shown in decision 406, it is determined whether an error between the actual refresh rate and a requested refresh rate (e.g. associated with a DVD player, etc.) is less than a threshold (e.g. +/−0.01%, etc.). In one embodiment, such error may include a percentage difference between the actual refresh rate and the requested refresh rate. For example, the error may be determined by dividing the actual refresh rate by the requested refresh rate. Of course, however, the error may be determined in any desired manner.

If it is determined that the error is not less than the threshold, a horizontal timing value is adjusted, as shown in operation 408. For example, if the error is greater than zero (e.g. and thus greater than ±0.01%), the horizontal blanking value component of the horizontal timing value is adjusted upwards. As another option, if the error is less than zero (e.g. and thus less than −0.01%), the horizontal blanking value component of the horizontal timing value is adjusted downwards.

Based on such adjustment of the horizontal timing value, an adjusted refresh rate is calculated (operation 404). In addition, it is again determined whether the adjusted refresh rate is less than the threshold (operation 406). If the refresh rate is still not determined to be less than the threshold, the horizontal timing value is again adjusted accordingly (operation 408).

Once it is determined that the error is less than the threshold, a vertical blanking value is recalculated based on the adjusted horizontal blanking value. In this way, adjusted horizontal and vertical timing values may be utilized for providing the adjusted refresh rate. In addition, if the error associated with the pixel clock received from the hardware feedback is initially less than the threshold, the horizontal blanking value is not necessarily adjusted, and, accordingly, recalculation of the vertical blanking value is not necessarily required.

Figure 5:
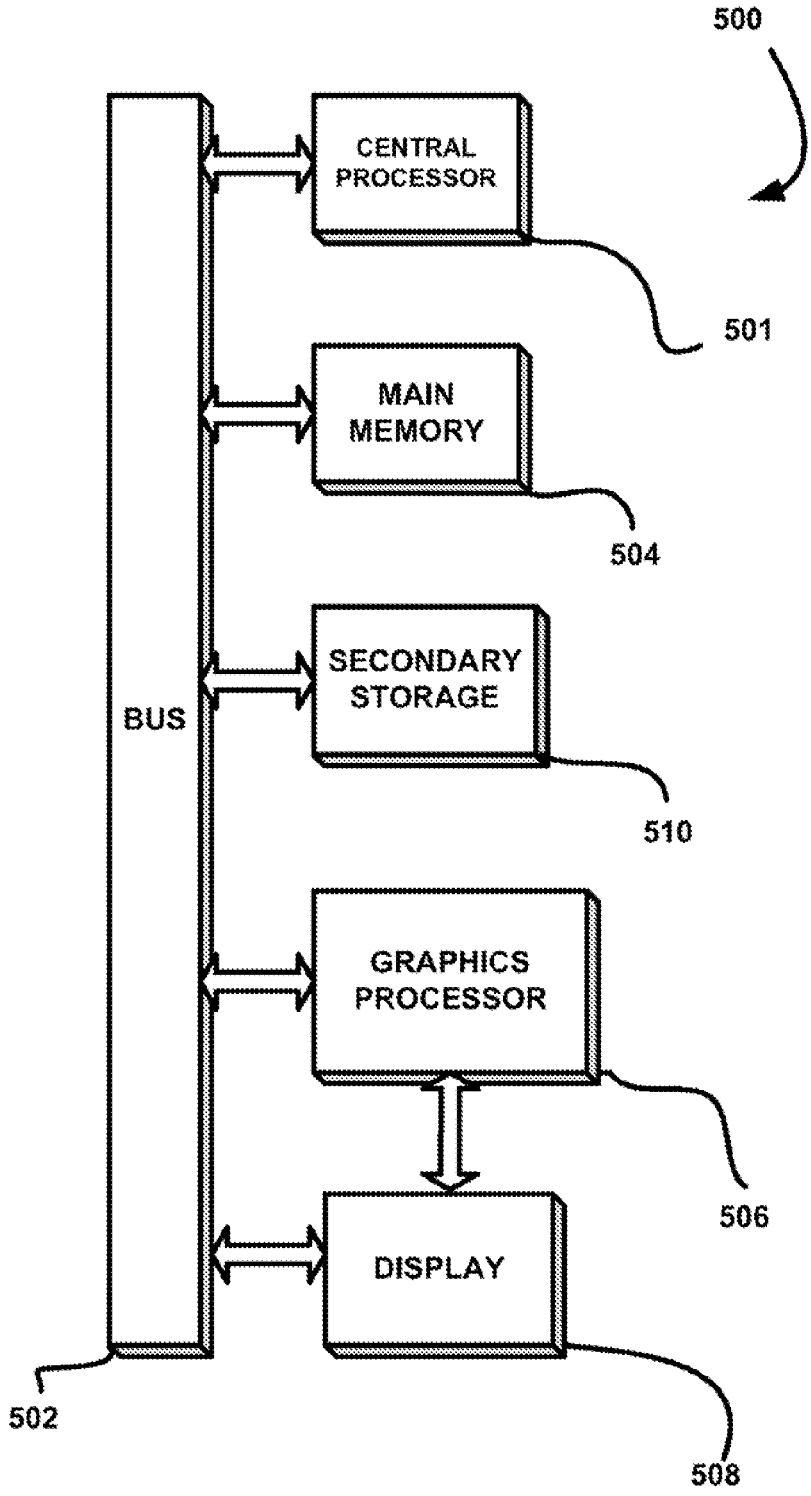
FIG. 5 illustrates an exemplary computer system in which the various architecture and/or functionality of the various previous embodiments may be implemented.

FIG. 5 illustrates an exemplary system 500 in which the various architecture and/or functionality of the various previous embodiments may be implemented. As shown, a system 500 is provided including at least one host processor 501 which is connected to a communication bus 502. The system 500 also includes a main memory 504. Control logic (software) and data are stored in the main memory 504 which may take the form of random access memory (RAM).

The system 500 also includes a graphics processor 506 and a display 508, i.e. a computer monitor. In one embodiment, the graphics processor 506 may include a plurality of shader modules, a rasterization module, etc. Each of the foregoing modules may even be situated on a single semiconductor platform to form a graphics processing unit (GPU).

In the present description, a single semiconductor platform may refer to a sole unitary semiconductor-based integrated circuit or chip. It should be noted that the term single semiconductor platform may also refer to multi-chip modules with increased connectivity which simulate on-chip operation, and make substantial improvements over utilizing a conventional central processing unit (CPU) and bus implementation. Of course, the various modules may also be situated separately or in various combinations of semiconductor platforms per the desires of the user.

The system 500 may also include a secondary storage 510. The secondary storage 510 includes, for example, a hard disk drive and/or a removable storage drive, representing a floppy disk drive, a magnetic tape drive, a compact disk drive, etc. The removable storage drive reads from and/or writes to a removable storage unit in a well known manner.

Computer programs, or computer control logic algorithms, may be stored in the main memory 504 and/or the secondary storage 510. Such computer programs, when executed, enable the system 500 to perform various functions. Memory 504, storage 510 and/or any other storage are possible examples of computer-readable media.

In one embodiment, the architecture and/or functionality of the various previous figures may be implemented in the context of the host processor 501, graphics processor 506, an integrated circuit (not shown) that is capable of at least a portion of the capabilities of both the host processor 501 and the graphics processor 506, a chipset (i.e. a group of integrated circuits designed to work and sold as a unit for performing related functions, etc.), and/or any other integrated circuit for that matter.

Still yet, the architecture and/or functionality of the various previous figures may be implemented in the context of a general computer system, a circuit board system, a game console system dedicated for entertainment purposes, an application-specific system, and/or any other desired system. For example, the system 500 may take the form of a desktop computer, lap-top computer, and or any other type of logic. Still yet, the system 500 may take the form of various other devices m including, but not limited to a personal digital assistant (PDA) device, a mobile phone device, a television, etc.

Further, while not shown, the system 500 may be coupled to a network [e.g. a telecommunications network, local area network (LAN), wireless network, wide area network (WAN) such as the Internet, peer-to-peer network, cable network, etc.) for communication purposes.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. A method, comprising:

receiving a pixel clock;

compensating for an error associated with the pixel clock;

calculating a refresh rate based on the compensation; and driving a display utilizing the refresh rate;

wherein the compensating is limited based on a predefined threshold;

wherein the predefined threshold includes a percentage change threshold.

2. The method of claim 1, wherein the pixel clock is associated with a graphics processor.

3. The method of claim 2, wherein the graphics processor includes a graphics processing unit.

4. The method of claim 2, wherein the compensation is based on an actual pixel clock value of a phase-locked loop of the associated graphics processor.

5. The method of claim 4, wherein the compensation is based on a difference between a requested pixel clock value and the actual pixel clock value.

6. The method of claim 1, wherein the compensating utilizes a feedback loop.

7. The method of claim 1, wherein the compensating includes modifying a horizontal timing value.

8. The method of claim 7, wherein the compensating includes modifying a horizontal blanking value of the horizontal timing value.

9. The method of claim 1, wherein the compensating includes modifying a vertical timing value.

10. The method of claim 9, wherein the compensating includes modifying a vertical blanking value of the vertical timing value.

11. The method of claim 1, wherein the compensating includes modifying a horizontal timing value prior to modifying a vertical timing value if a layout of visual data to be displayed by the display includes a landscape layout.

12. The method of claim 1, wherein the compensating includes modifying a vertical timing value prior to modifying a horizontal timing value if a layout of visual data to be displayed by the display includes a portrait layout.

13. The method of claim 1, wherein the error includes a difference between the pixel clock and a requested pixel clock.

14. The method of claim 13, wherein the requested pixel clock is associated with a device separate from the display.

15. The method of claim 14, wherein the device includes a digital versatile disc (DVD) player.

16. The method of claim 1, wherein the refresh rate is calculated as a function of the pixel clock.

17. The method of claim 1, wherein the refresh rate is utilized by a graphics processor for driving the display.

18. The method of claim 1, wherein the compensation reduces frame dropping at the display.

19. The method of claim 1, wherein the predefined threshold is based on a particular graphics processor for which the error is being compensated.

20. The method of claim 1, wherein the predefined threshold is based on a maximum compensation capable of being utilized while preventing a divergent result.

21. The method of claim 1, wherein the pixel clock is associated with an error range.

22. A system, comprising:

a processor for receiving a pixel clock; and a driver in communication with the processor, the driver adapted for compensating for an error associated with the pixel clock by calculating a compensated refresh rate for use in driving a display;

wherein the compensating is limited based on a predefined threshold;

wherein the predefined threshold includes a percentage change threshold.

23. The system of claim 22, wherein the display is coupled to the processor via a bus.

24. A computer program product embodied on a computer readable medium, comprising:

computer code for compensating for an error associated with a pixel clock;

computer code for calculating a refresh rate based on the compensation; and computer code for driving a display utilizing the refresh rate;

wherein the compensating is limited based on a predefined threshold;

wherein the predefined threshold includes a percentage change threshold.

* * * * *